US010736470B2

(12) United States Patent
Preece et al.

(10) Patent No.: US 10,736,470 B2
(45) Date of Patent: Aug. 11, 2020

(54) MODULAR SEATING APPARATUS AND CORRESPONDING SYSTEMS

(71) Applicant: Medline Industries, Inc., Northfield, IL (US)

(72) Inventors: Roy Preece, McHenry, IL (US); Frank Martorelli, Hoffman Estates, IL (US); John Shelpman, Deerfield, IL (US); Cristobal J Rodriguez, Elgin, IL (US)

(73) Assignee: Medline Industries, Inc., Northfield, IL (US)

( * ) Notice: Subject to any disclaimer, the term of this patent is extended or adjusted under 35 U.S.C. 154(b) by 14 days.

(21) Appl. No.: 15/663,552

(22) Filed: Jul. 28, 2017

(65) Prior Publication Data

US 2019/0029474 A1 Jan. 31, 2019

(51) Int. Cl.

| | |
|---|---|
| ***A47K 3/28*** | (2006.01) |
| ***A47C 4/03*** | (2006.01) |
| ***A47C 13/00*** | (2006.01) |
| *A47C 5/12* | (2006.01) |
| *A47C 4/02* | (2006.01) |

(52) U.S. Cl.

CPC ..... *A47K 3/282* (2013.01); *A47C 4/03* (2013.01); *A47C 13/005* (2013.01); *A47C 4/021* (2013.01); *A47C 5/12* (2013.01)

(58) Field of Classification Search

CPC ..... A47K 3/282; A47K 3/12; A47K 3/122; A47K 3/125; A47K 3/127; A47C 4/03; A47C 4/021; A47C 1/124; E04B 1/6179; E04B 1/6125

USPC ..... 4/578.1, 560.1, 571.1, 573.1, 579, 604; 297/333, 248; 108/65, 69, 83, 157.1, 108/157.16, 157.18; 52/588.1

See application file for complete search history.

(56) References Cited

U.S. PATENT DOCUMENTS

| | | | | |
|---|---|---|---|---|
| 3,528,096 | A * | 9/1970 | Moberg | A47C 3/026 297/130 |
| 3,855,646 | A | 12/1974 | Glickman | |
| 3,944,281 | A | 3/1976 | Piretti | |
| 4,168,549 | A | 9/1979 | Davies | |
| 4,391,006 | A | 7/1983 | Smith | |
| 4,472,844 | A | 9/1984 | Mace | |

(Continued)

FOREIGN PATENT DOCUMENTS

| | | |
|---|---|---|
| CA | 2737286 | 9/2012 |
| CA | 3007105 | 6/2017 |

(Continued)

OTHER PUBLICATIONS

Seating Device Images gathered by inventors; Unknown original publication of each image; Unknown publication dates but believed to be prior to filing of present application.

(Continued)

*Primary Examiner* — Erin Deery
(74) *Attorney, Agent, or Firm* — Philip H. Burrus, IV

(57) ABSTRACT

A device (100) includes a substantially planar portion (101) defining a seat (106). One or more legs (110,111,112,113) are coupled to, and support, the seat. The seat includes a first seat edge (104) defining a bench receiver (122) that is selectively attachable to a seat receiver (422) of a bench (400) to extend the substantially planar portion along a plane (107) defined by the substantially planar portion by a predefined additional width (601).

20 Claims, 8 Drawing Sheets

(56) References Cited

U.S. PATENT DOCUMENTS 4,475,256 A 10/1984 Hatala
D276,767 S 12/1984 Livi
D296,284 S 6/1988 Colby
D300,996 S 5/1989 Colby
D347,526 S 6/1994 Hamilton
5,335,377 A 8/1994 Masyada et al.
5,361,428 A 11/1994 Nanowsky et al.
5,536,068 A 7/1996 Valentor et al.
5,561,868 A 10/1996 Campbell et al.
D375,638 S 11/1996 Dhanapal et al.
5,630,304 A * 5/1997 Austin ..... E04F 15/10 428/57
5,845,962 A 12/1998 Lin
5,940,905 A 8/1999 Cheng
6,000,750 A 12/1999 Rossman et al.
6,039,403 A 3/2000 Hargroder
6,065,251 A 5/2000 Kindrick
D427,814 S 7/2000 Black
6,105,183 A 8/2000 Bly
6,122,776 A 9/2000 Cheng
D439,429 S 3/2001 Higgs et al.
D466,337 S 12/2002 Feng
D478,749 S 8/2003 Gilbert et al.
D478,750 S 8/2003 Gilbert et al.
D478,751 S 8/2003 Gilbert et al.
D478,752 S 8/2003 Gilbert et al.
D479,051 S 9/2003 Darst et al.
D479,067 S 9/2003 Gilbert et al.
6,733,082 B1 * 5/2004 Treon ..... A47C 1/16 297/248
6,827,028 B1 12/2004 Callaway
D501,611 S 2/2005 Self et al.
6,907,829 B2 * 6/2005 Bambach ..... A47B 96/025 108/152
D519,291 S 4/2006 Higgs et al.
7,020,911 B2 4/2006 Oldham
7,121,620 B1 10/2006 Fang
7,451,501 B2 11/2008 Cheng
D582,185 S 12/2008 Gilbert
D596,866 S 7/2009 Bergmann et al.
7,661,154 B2 2/2010 Cheng
7,690,055 B2 4/2010 Hammer et al.
7,761,935 B1 7/2010 Whitaker
D637,417 S 5/2011 Marcomini
8,127,377 B2 3/2012 Ferrazzani
8,152,233 B2 4/2012 Wechter
8,162,396 B2 * 4/2012 Edwards ..... A47C 4/02 297/188.08
8,181,285 B1 5/2012 Jackson
8,291,526 B2 * 10/2012 Parvizian ..... A47C 16/02 297/423.1
8,307,600 B2 * 11/2012 Heartsfield ..... E04F 15/02 52/177
D687,640 S 8/2013 Pedersen et al.
8,925,264 B2 * 1/2015 Thrush ..... E04F 15/02016 52/177
D723,814 S 3/2015 Hagstrom
9,107,787 B2 * 8/2015 Wechter ..... A47K 3/122
9,662,255 B2 5/2017 Wechter
9,763,545 B2 9/2017 Liu
D802,311 S 11/2017 Stricklin et al.
D822,420 S 7/2018 Paterson et al.
D823,020 S 7/2018 Paterson et al.
D833,765 S 11/2018 Mammi
2004/0051365 A1 3/2004 Darst
2004/0070238 A1 4/2004 Moser et al.
2005/0179304 A1 8/2005 Serhan
2007/0273181 A1 11/2007 Wechter
2010/0288453 A1 11/2010 Richardson
2012/0192351 A1 8/2012 Wechter
2012/0233767 A1 * 9/2012 Liu ..... A47K 3/122 4/578.1
2013/0117928 A1 5/2013 Hardie
2016/0143493 A1 * 5/2016 Chang ..... A47K 13/005 4/237
2016/0278529 A1 9/2016 Paterson et al.
2017/0303747 A1 * 10/2017 Fortman ..... A47K 3/12

FOREIGN PATENT DOCUMENTS

DE 10206835 A1 * 9/2003 ..... B28B 19/003
WO 2001/070088 9/2001
WO WO-2017093734 A1 * 6/2017

OTHER PUBLICATIONS

"Briggs Healthcare", Shower Chair; http://www.walmart.com/ip/Mabis-DMI-Shower-Chair-with-Arms-and-Back-Rest/12354572; Unknown publication date but believe to be prior to filing of present application.
"DeVilbiss Healthcare", Shower Chair with Back; http://www.drivemedical.com/b2b/index.php/shower-chair-with-back-and-removable-padded-arms-217.html; Unknown Publication Date but believe to be prior to filing of present application.
"Essential Medical", Molded Shower Chair; http://www.walmart.com/ip/Essential-Medical-B3011-Molded-Shower-Bench-with-Arms-Back/35306400; Unknown publication date but believe to be prior to filing of present application.
"RehabMart.com", Adjustable Shower Seats; http://www.rehabmart.com/product/adjustable-shower-seats-18745.html; Unknown Publication Date but believe to be prior to filing of present application.
"Single Cube Chair", CFC-999 Preschool Chairs; Hertz Furniture Website; http://www.hertzfurniture.com/Preschool---Chairs-------Single---Cube---Chair------3462------mo.html; Unknown Publication Date but prior to filing of present application.
De, Mimosa , "Notice of Allowance", U.S. Appl. No. 29/558,299, filed Mar. 16, 2016; dated Dec. 12, 2017.
Ros, Nicholas , "NonFinal OA", U.S. Appl. No. 14/845,235, filed Sep. 3, 2015; dated May 2, 2017.
Ros, Nicholas , "NonFinal OA", U.S. Appl. No. 14/845,235, filed Sep. 3, 2015; dated Nov. 22, 2017.
"Medline Catalog", Basic Shower Chair with Back; Medline Catalog; https://www.medline.com/catalog/catalog.jsp; Unknown Publication date but believed to be prior to present application filing date.
"Medline Catalog", Composite Bath Benches with Back; Medline Catalog; https://www.medline.com/catalog/catalog.jsp; Unknown Publication date but believed to be prior to present application filing date.
"Medline Catalog", Composite Transfer Benches; Medline Catalog; https://www.medline.com/catalog/catalog.jsp; Unknown Publication date but believed to be prior to present application filing date.
"Medline Catalog", Easy Care Shower Chair/Stool; Medline Catalog; https://www.medline.com/catalog/catalog.jsp; Unknown Publication date but believed to be prior to present application filing date.
"Medline Catalog", Home Care Glacier Shower Chair by Moen; Medline Catalog; https://www.medline.com/catalog/catalog.jsp; Unknown Publication date but believed to be prior to present application filing date.
"Medline Catalog", Knockdown Transer Benches; Medline Catalog; https://www.medline.com/catalog/catalog.jsp; Unknown Publication date but believed to be prior to present application filing date.
"Medline Catalog", Shower Chair with Back; Medline Catalog; https://www.medline.com/catalog/catalog.jsp; Unknown Publication date but believed to be prior to present application filing date.
"Medline Catalog", Shower Chair with Perineal Opening; Medline Catalog; https://www.medline.com/catalog/catalog.jsp; Unknown Publication date but believed to be prior to present application filing date.
"Medline Catalog", Shower Chairs with Microban; Medline Catalog; https://www.medline.com/catalog/catalog.jsp; Unknown Publication date but believed to be prior to present application filing date.

(56) References Cited

OTHER PUBLICATIONS

"Medline Catalog", Shower Chais/Stools by Invacare Corp; Medline Catalog; https://www.medline.com/catalog/catalog.jsp; Unknown Publication date but believed to be prior to present application filing date.
"Medline Catalog", Snap N Save Heavy Duty Shower Chairs by Performance Health; Medline Catalog; https://www.medline.com/catalog/catalog.jsp; Unknown Publication date but believed to be prior to present application filing date.
De, Mimosa , "Notice of Allowance", U.S. Appl. No. 29/558,299, filed Mar. 16, 2016; dated Mar. 26, 2018.
De, Mimosa , "Notice of Allowance", U.S. Appl. No. 29/570,679, filed Jul. 11, 2016; dated Mar. 8, 2018.
De, Mimosa , "Notice of Allowance", U.S. Appl. No. 29/612,169, filed Jul. 28, 2017; dated Mar. 25, 2019.
Ros, Nicholas , "Notice of Allowance", U.S. Appl. No. 14/845,235, filed Sep. 3, 2015; dated Aug. 7, 2019.
Ros, Nicholas , "Notice of Allowance", U.S. Appl. No. 14/845,235, filed Sep. 3, 2015; dated Oct. 25, 2019.

* cited by examiner

MODULAR SEATING APPARATUS AND CORRESPONDING SYSTEMS

BACKGROUND

Technical Field

This disclosure relates generally to seating devices, and more particularly to modular seating devices.

Background Art

Some people, including those who are infirm, elderly, or otherwise impaired, require assistance during daily activities. For example, while many take the act of taking a shower or getting into a tub for granted, others require special assistance to complete this simple task. A wheelchair bound person may require special equipment to move from wheelchair to tub and vice versa. One such piece of equipment suitable for this task is known as a "transfer bench." Traditional transfer benches straddle the edge of the tub so that the user can slide from the wheelchair into the tub for bathing.

Prior art transfer benches are lack the ability of the user to customize the device so as to tailor it to their personal needs. Prior art designs also interfere with the shower curtain, resulting in seat instability and water on the floor. It would be advantageous to have an improved seating device.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and to explain various principles and advantages all in accordance with the present disclosure.

Figure 1:
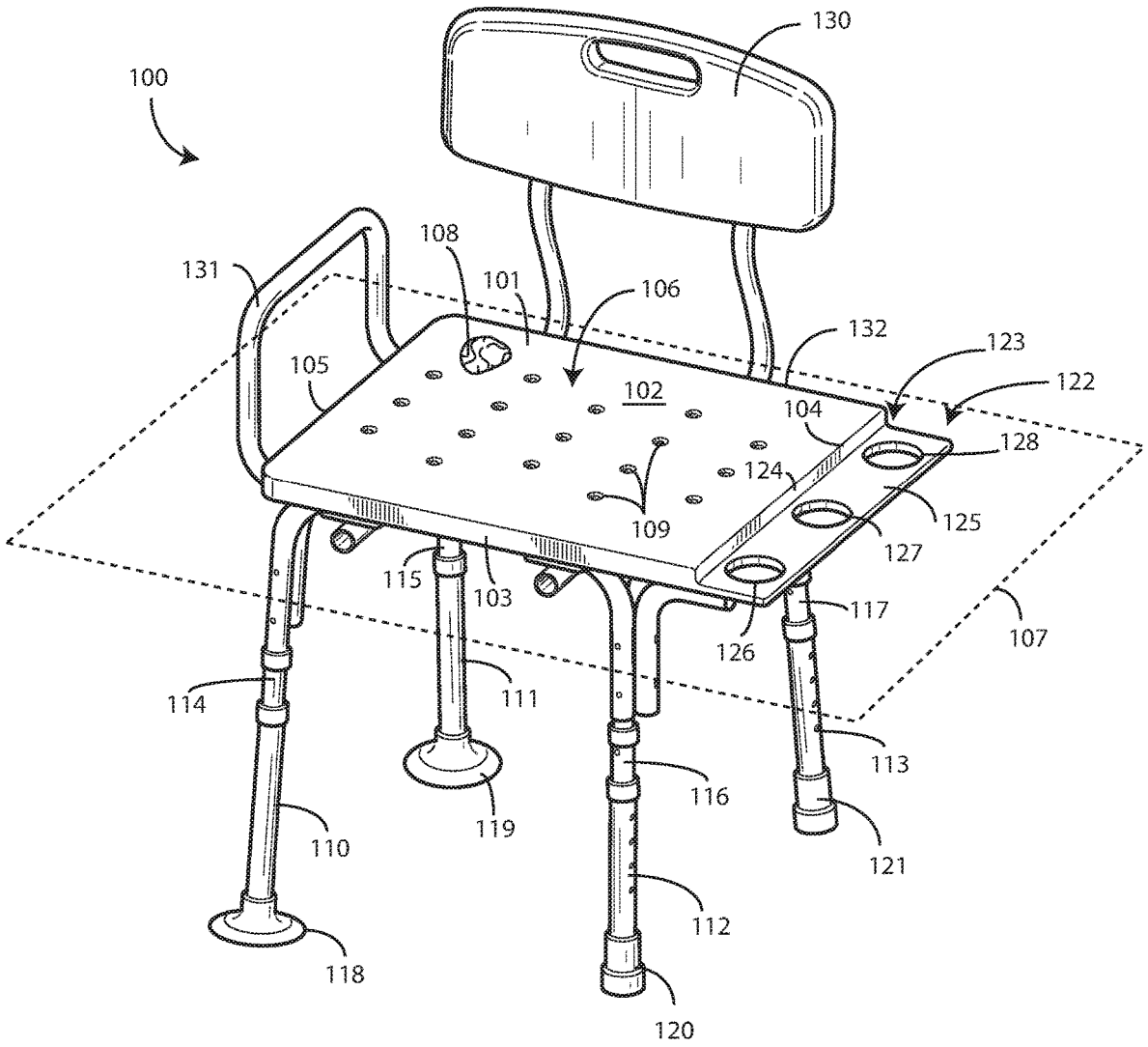
FIG. 1 illustrates a perspective view of one explanatory device suitable for use in an explanatory modular seating apparatus in accordance with one or more embodiments of the disclosure.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present disclosure.

DETAILED DESCRIPTION OF THE DRAWINGS

Embodiments of the disclosure are now described in detail. Referring to the drawings, like numbers indicate like parts throughout the views. As used in the description herein and throughout the claims, the following terms take the meanings explicitly associated herein, unless the context clearly dictates otherwise: the meaning of "a," "an," and "the" includes plural reference, the meaning of "in" includes "in" and "on." Relational terms such as first and second, top and bottom, and the like may be used solely to distinguish one entity or action from another entity or action without necessarily requiring or implying any actual such relationship or order between such entities or actions.

As used herein, components may be "operatively coupled" when information can be sent between such components, even though there may be one or more intermediate or intervening components between, or along the connection path. The terms "substantially" and "about" are used to refer to dimensions, orientations, or alignments inclusive of manufacturing tolerances. Thus, a "substantially orthogonal" angle with a manufacturing tolerance of plus or minus two degrees would include all angles between 88 and 92, inclusive. Also, reference designators shown herein in parenthesis indicate components shown in a figure other than the one in discussion. For example, talking about a device (10) while discussing figure A would refer to an element, 10, shown in figure other than figure A.

Embodiments of the disclosure describe a modular seating apparatus, which can be configured as a seat and bench combination in one or more embodiments. In one embodiment a first device comprises a substantially planar portion defining a seat. One or more legs can be coupled to the seat, beneath the seat, so as to support the seat when the one or more legs are positioned on a surface such as a floor, shower tub bottom, and so forth.

In one or more embodiments, the seat comprises a first seat edge. In one or more embodiments, the first seat edge defines a bench receiver that is selectively attachable to a seat receiver of a bench to extend the substantially planar portion along a plane defined by the substantially planar portion by a predefined additional width.

In one or more embodiments the bench comprises another substantially planar portion. One or more additional legs are attached to a bottom side of the other substantially planar portion to support the other substantially planar portion when the one or more additional legs are positioned on a surface such as a floor, shower tub bottom, and so forth.

In one or more embodiments, the other substantially planar portion comprises a first bench edge. In one or more embodiments, the first bench edge defines a seat receiver. In one or more embodiments, the seat receiver is complementary, in geometry, to the bench receiver. The seat receiver is selectively attachable to the bench receiver to couple the bench to the first device to extend the substantially planar portion defining the seat by the predefined additional width.

Advantageously, in one or more embodiments the bench is separable from the first device comprising the seat. Accordingly, in one or more embodiments the first device can be placed in a tub. The bench can then be placed outside the tub. When the bench receiver couples to the seat receiver, the other planar portion of the bench extends over a side of the tub, thereby allowing a person to sit on the bench and slide to the seat. However, to allow a shower door or shower curtain to close without interference from the modular seating device, in one or more embodiments the bench can be removed so that the seat is entirely contained within the tub. After bathing, the bench can be reattached to the first device to allow the person to exit the tub.

Advantageously, embodiments of the disclosure provide a modular seating apparatus with a bench that is detachable from a seat to allow a shower curtain or shower door to be closed without interference from the seating apparatus, while still enabling a person to access the seating apparatus from outside the tub or shower. When the bench is detached from the seat, the seat and its corresponding components remain within the tub or shower while the bench remains outside. A shower door or shower curtain can then be closed to prevent water from leaking from the shower or tub onto the floor. The bench can then be reattached to the seat to allow egress from the shower or tub by sliding from the seat to the bench.

Embodiments of the disclosure provide a new, innovative, and advantageous modular bench for the shower or bath. Designed to adapt to the changing needs of the user, the modular seating apparatus is made to last from durable materials such as polyurethane and steel. Advantageously, embodiments of the disclosure can be configured as a transfer bench, stand-alone bench, simple seat, or in other configurations.

Figure 2:
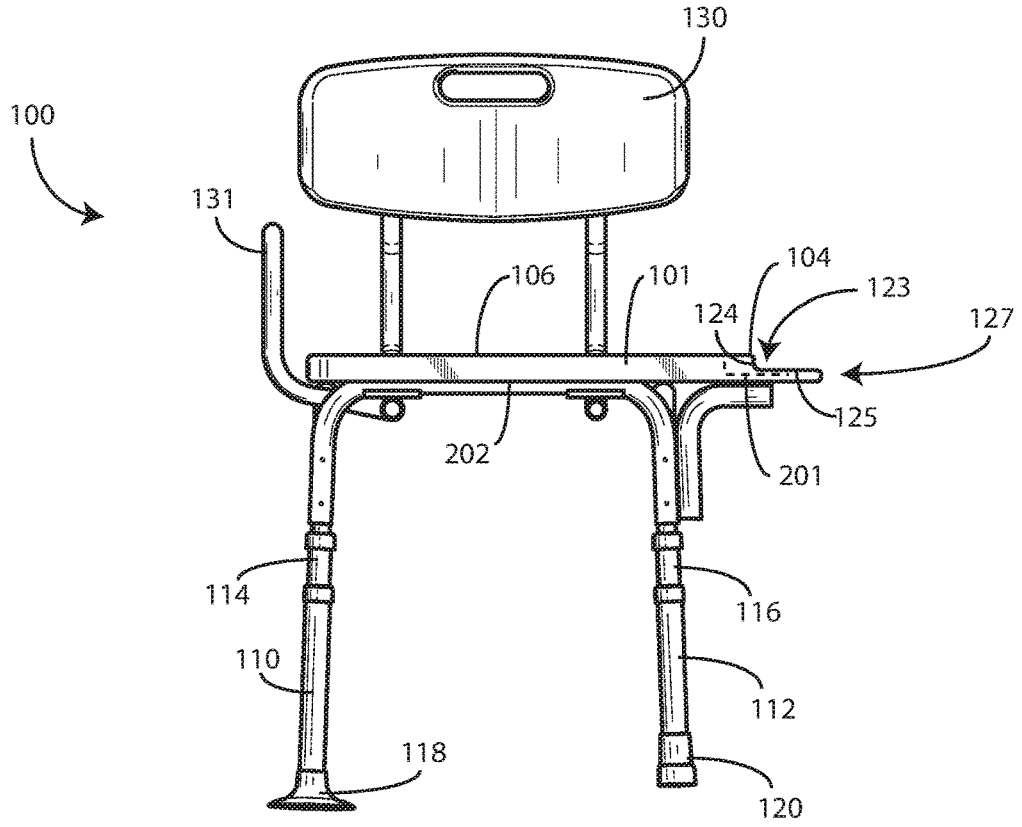
FIG. 2 illustrates a front elevation view of one explanatory device suitable for use in an explanatory modular seating apparatus in accordance with one or more embodiments of the disclosure.
Figure 3:
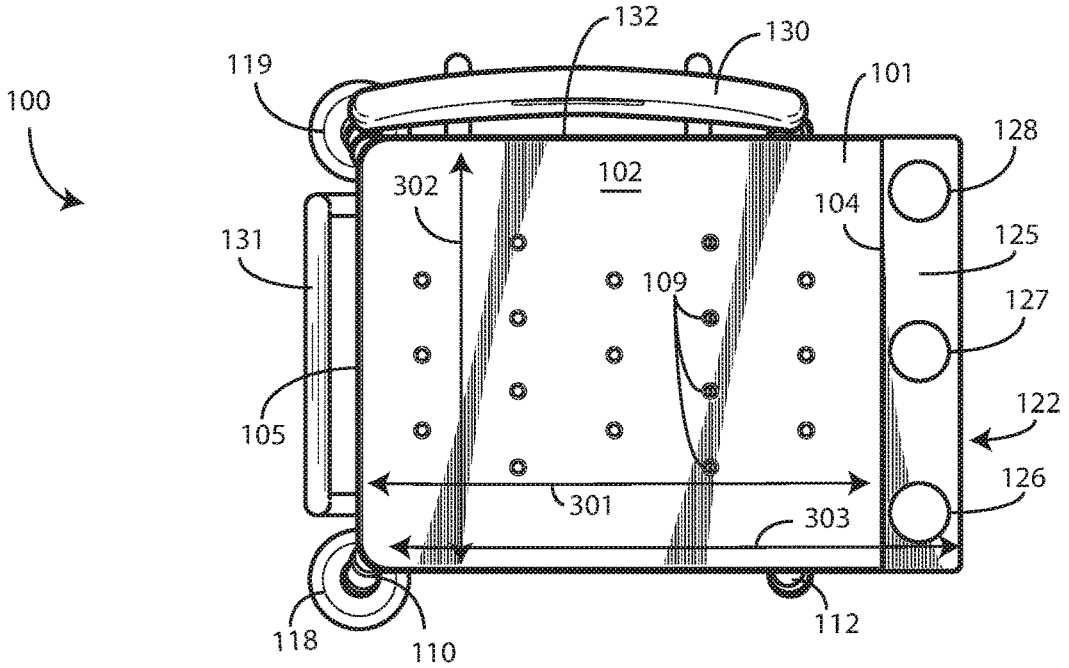
FIG. 3 illustrates a top plan view of one explanatory device suitable for use in an explanatory modular seating apparatus in accordance with one or more embodiments of the disclosure.
Figure 4:
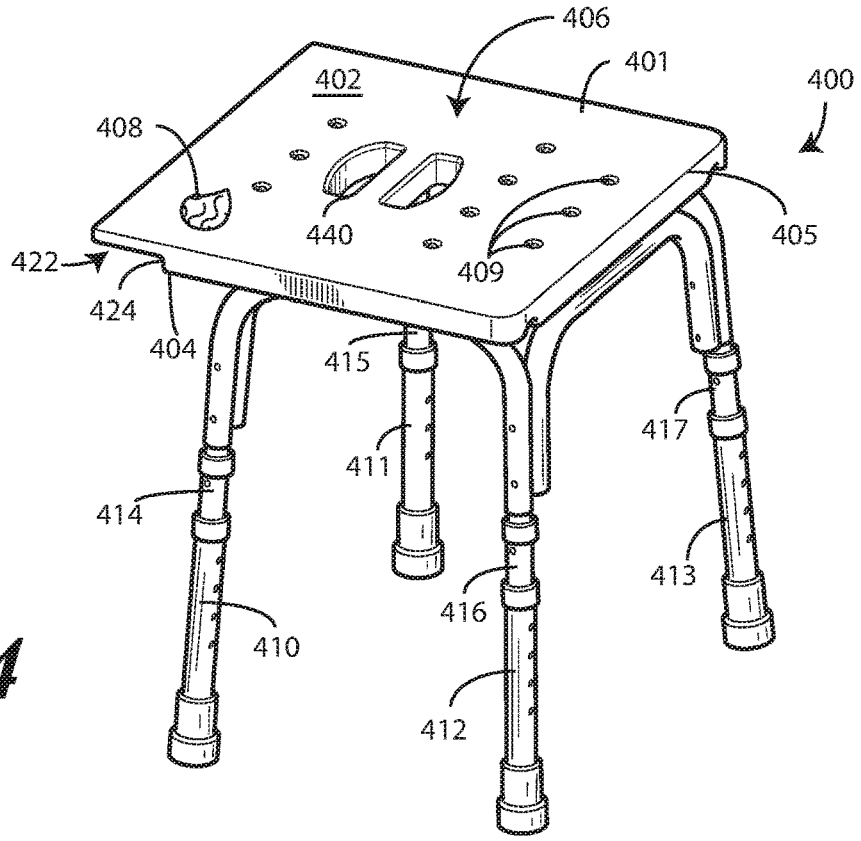
FIG. 4 illustrates a first perspective view of a bench in accordance with one or more embodiments of the disclosure.

Turning now to FIGS. 1-3, illustrated therein is one explanatory device 100 suitable for use in a modular seating apparatus and configured in accordance with one or more embodiments of the disclosure. The device 100 includes a substantially planar portion 101 defining a seat 106. Specifically, the substantially planar portion 101 has a first major face 102 and a second major face 202. One or more minor faces 103 extend from the first major face 102 to the second major face 202. The first major face 102 defines the seating surface of the seat 106 in one or more embodiments.

In one or more embodiments, the substantially planar portion 101 includes a first seat edge 104 and a second seat edge 105. In this illustrative embodiment, the second seat edge 105 is disposed opposite the substantially planar portion 101 from the first seat edge 104. Said differently, the substantially planar portion 101 is situated between the first seat edge 104 and the second seat edge 105.

In one or more embodiments, the substantially planar portion 101 can be manufactured from a material with sufficient rigidity as to support the weight of a user and allow the lateral movement (such as sliding movement) of the user across the seat 106. Examples of such materials include high-strength thermoplastic materials, metal, wood, wood composites, aluminum, fiberglass, or combinations thereof. Still other suitable materials will be obvious to those of ordinary skill in the art having the benefit of this disclosure. For example, in one embodiment the substantially planar portion 101 is manufactured from a blow-molded thermoplastic, such as polyurethane. In another embodiment, the substantially planar portion 101 is manufactured from an injection molding process. In another embodiment, the substantially planar portion 101 is manufactured from a gas-blown injection molding process, which allows for a wide range of color choices. In another embodiment, the substantially planar portion 101 is manufactured from a co-molding process that involves both blow molding and injection molding. Other suitable materials include high modulus polypropylene. Where metal is used, the metal may be coated with a rust corrosion preventative material. In other cases, a rust-resistant material, such as aluminum or stainless steel, can be used as well.

In this illustrative embodiment, the substantially planar portion 101 defines a plane 107 that is oriented substantially horizontally when the device 100 is in use. In this illustrative embodiment, the substantially planar portion 101 is rectangular when viewed in the plan view of FIG. 3. However, the substantially planar portion 101 could take other shapes as well. Additionally, while the seat 106 in this illustrative embodiment is substantially planar, in other embodiments it can have contours, recesses, and/or protrusions to better fit portions of a user's anatomy, such as their derriere. However, as will be shown in FIGS. 8-10 below, in one or more embodiments the seat 106 is configured to be substantially planar so that the device 100 can be coupled to a bench to form a modular seating apparatus referred to as a "transfer bench." Additionally, embodiments of the disclosure contemplate that it is frequently easier for a user to slide across a substantially planar surface than a curved surface in many instances.

In one or more embodiments, the first major face 102 includes a textured surface 108 disposed along the first major face 102 of the seat 106. This textured surface 108 is optional. Where included, it creates an exciting ornamental aesthetic. At the same time the textured surface 108 also provides grip and control to the user when in use. In other embodiments, however, the textured surface 108 is omitted and the first major face 102 of the seat 106 is substantially smooth.

In one or more embodiments, one or more apertures 109 are disposed along the seat 106 to provide integrated drainage features. The textured surface 108, where included, may also include raised portions disposed along selective areas to allow for water drainage through the one or more apertures 109. Additionally, where included the textured surface 108 can increase friction, helping to ensure a user does not slip off the seat 106. Embodiments of the disclosure contemplate that too many voids disposed along the seat 106 may weaken the structural integrity of the device 100. The textured surface 108 may also function to direct water to some of the apertures 109 as well.

As shown in FIGS. 1-3, one or more legs 110,111,112,113 are coupled to the second major face 202 of the substantially planar portion 101. The one or more legs 110,111,112,113 are disposed beneath the seat 106 when the device 100 is in use, as viewed in FIG. 2. Accordingly, the one or more legs 110,111,112,113 are configured to support the seat 106, and perform a supporting function when the device 100 is in use.

The number of legs may vary. In the illustrative embodiment of FIGS. 1-3, the one or more legs 110,111,112,113 comprise four legs, each being sized and arranged to provide adequate support for a user when sitting on the device 100. In other embodiments, however, the device may include one, two, three, or five or more legs.

In one or more embodiments, the one or more legs 110,111,112,113 are configured to situate within a bathtub or shower. The one or more legs 110,111,112,113 may be configured to situate within a variety of bathtub or shower sizes. Illustrating by example, the one or more legs 110,111, 112,113 shown in FIGS. 1-3 are adjustable by way of telescoping adjustment mechanisms 114,115,116,117. This allows not only for the accommodation of various bathtub and shower sizes, but also provides adjustability of the seat 106 so that a user can sit at different heights. While telescoping adjustment mechanisms 114,115,116,117 are one example of an adjustment device, other mechanisms allowing adjustment will be obvious to those of ordinary skill in the art having the benefit of this disclosure. The telescoping adjustment mechanisms may have spring-pin or pushbutton engagement members to engage apertures in the one or more legs 110,111,112,113 that allow each of the one or more legs 110,111,112,113 to be locked at a desired height.

The one or more legs 110,111,112,113 may be constructed from a variety of materials. Illustrating by example, in one embodiment the one or more legs 110,111,112,113 are manufactured from steel. In another embodiment, the one or more legs 110,111,112,113 are manufactured from aluminum. In another embodiment, the one or more legs 110,111, 112,113 are manufactured from carbon fiber. In another embodiment, the one or more legs 110,111,112,113 are manufactured from plastic. Other materials suitable for manufacturing the one or more legs 110,111,112,113 will be obvious to those of ordinary skill in the art having the benefit of this disclosure.

In one or more embodiments, at least one of the one or more legs 110,111,112,113 is configured to keep the device 100 stable in a tub or shower. At least one of the one or more legs 110,111,112,113 may be configured to prevent the device 100 from slipping or sliding in a tub or shower. Illustrating by example, the ends of at least one of the one or more legs 110,111,112,113 may include a material that prevents sliding, such as a material having a sticky or abrasive surface. In the illustrative embodiment of FIGS. 1-3, legs 110,111 are each configured with a suction cup 118,119, while legs 112,113 are each configured with a skid-resistant cap 120,121. The suction cup 118,119 and/or skid-resistant cap 120,121 can be manufactured from a soft rubber or pliable plastic material. Slippage preventative devices other than the suction cup 118,119 or skid-resistant cap 120,121 will be obvious to those of ordinary skill in the art having the benefit of this disclosure.

In one or more embodiments, the first seat edge 104 defines a bench receiver 122. In this illustrative embodiment, the bench receiver 122 extends from an edge of the first major face 102 to an edge of the second major face 202. In one or more embodiments, the bench receiver 122 is selectively attachable to a seat receiver of a bench, as will be described below with reference to FIGS. 8-10. When attached to the seat receiver of a bench, the bench receiver 122 allows the substantially planar portion 101 to be extended along the plane 107 defined by the substantially planar portion 101 by a predefined additional width.

In the illustrative embodiment of FIGS. 1-3, the bench receiver 122 defines a concave-up recess 123 that is cut into the substantially planar portion 101. In this illustrative embodiment, the bench receiver 122 comprises a first side 124 and a second side 125, which intersect at a substantially orthogonal angle. This results in the bench receiver 122 defining a concave-up L-shaped recess, with the L-shape 201 shown in FIG. 2.

In the illustrative embodiment of FIGS. 1-3, the first side 124 of the bench receiver 122 is substantially orthogonal with the first major face 102 of the substantially planar portion 101, as best seen in FIG. 2. The second side 125 of the bench receiver 122 is then substantially orthogonal with the first side 124, thereby defining the interior of the L-shape 201.

In one or more embodiments, the concave-up L-shaped recess comprises at least one connector 126,127,128. In the illustrative embodiment of FIGS. 1-3, the concave-up L-shaped recess comprises three connectors 126,127,128, with each being disposed along the second side 125 of the bench receiver 122. In other embodiments, one, two, or four or more connectors could be used.

While the connectors 126,127,128 can be any of various types of connectors, such as male connectors, female connectors, snap connectors, and so forth, in the illustrative embodiment of FIGS. 1-3 the three connectors 126,127,128 comprise at least one female connector. Specifically, in this illustrative embodiment the three connectors 126,127,128 are three female connectors, each defining an aperture in the second side 125 of the bench receiver 122. In this illustrative embodiment, the apertures are circular holes that pass completely through the second side 125 of the bench receiver 122. In other embodiments, the apertures only partially pass through the second side 125 of the bench receiver 122. While the apertures are circular in shape in FIGS. 1-3, they can take other shapes as well, including squares, triangles, polygons, or free-form shapes.

In one or more embodiments, the seat 106 defines a seat width 301 and a seat length 302. Note that in this illustrative embodiment, the seat width 301, which defines the width of the first major face 102, is less than the width 303 of the second major face 202. Said differently, the width 303 of the second major face 202 is greater than the seat width 301 in this illustrative embodiment.

While different designs will have different seat widths and lengths, in one explanatory embodiment the seat width 301 is between sixteen and seventeen inches. In one embodiment, the seat width 301 is about 16.7 inches. In one embodiment the seat length 302 is shorter than the seat width 301. For example, in one embodiment the seat length 302 is between fifteen and sixteen inches. In one embodiment, the seat length 302 is about 15.7 inches. These dimensions are illustrative only, as others will be readily apparent to those of ordinary skill in the art having the benefit of this disclosure.

In one or more embodiments, one or more accessories can be attached to the substantially planar portion 101. In the illustrative embodiment of FIGS. 1-3, two explanatory accessories are shown: a backrest 130 and an arm rest 131. The backrest 130 is coupled to a third seat edge 132 of the substantially planar portion 101, while the arm rest 131 is coupled to the second seat edge 105 of the substantially planar portion 101. While these two accessories are shown, other accessories, such as a combination soap dish and showerhead holder, can be coupled to the substantially planar portion 101 as well. Still other accessories suitable for coupling to the substantially planar portion will be obvious to those of ordinary skill in the art having the benefit of this disclosure. In one or more embodiments, each accessory can be attached to the substantially planar portion 101 with a threaded retention device or other coupling device.

Turning now to FIGS. 4-7, illustrated therein is one explanatory bench 400 suitable for use in a modular seating apparatus and configured in accordance with one or more embodiments of the disclosure. The bench 400 includes another substantially planar portion 401 defining a transfer surface 406. In one or more embodiments, the other substantially planar portion 401 has a first major face 402 and a second major face 503. The first major face 402 defines the top major surface of the other substantially planar portion 401, while the second major face 403 defines a bottom major surface of the substantially planar portion 401 in this illustrative embodiment. One or more minor faces extend from the first major face 402 to the second major face 503. The first major face 402 defines a transfer surface along which a user can slide when moving, for example, from a wheelchair to the seat (106) of the device (100) of FIGS. 1-3.

In one or more embodiments, the substantially planar portion 401 includes a first bench edge 404 and a second bench edge 405. In this illustrative embodiment, the second bench edge 405 is disposed opposite the other substantially planar portion 401 from the first bench edge 404 as shown.

In one or more embodiments, the other substantially planar portion 401 can be manufactured from the same material as the substantially planar portion (101) of the device (100) of FIGS. 1-3. In other embodiments, the other substantially planar portion 401 can be manufactured from a different material than the substantially planar portion (101) of the device (100) of FIGS. 1-3. For example, both the other substantially planar portion 401 and the substantially planar portion (101) of the device (100) of FIGS. 1-3 can be manufactured from the same high-strength thermoplastic material, metal, wood, wood composite, aluminum, fiberglass, or combinations thereof. In other embodiments, the substantially planar portion (101) of the device (100) of FIGS. 1-3 may be manufactured from a high-strength thermoplastic material, while the other substantially planar portion 401 is manufactured from a composite, and so forth.

Figure 6:
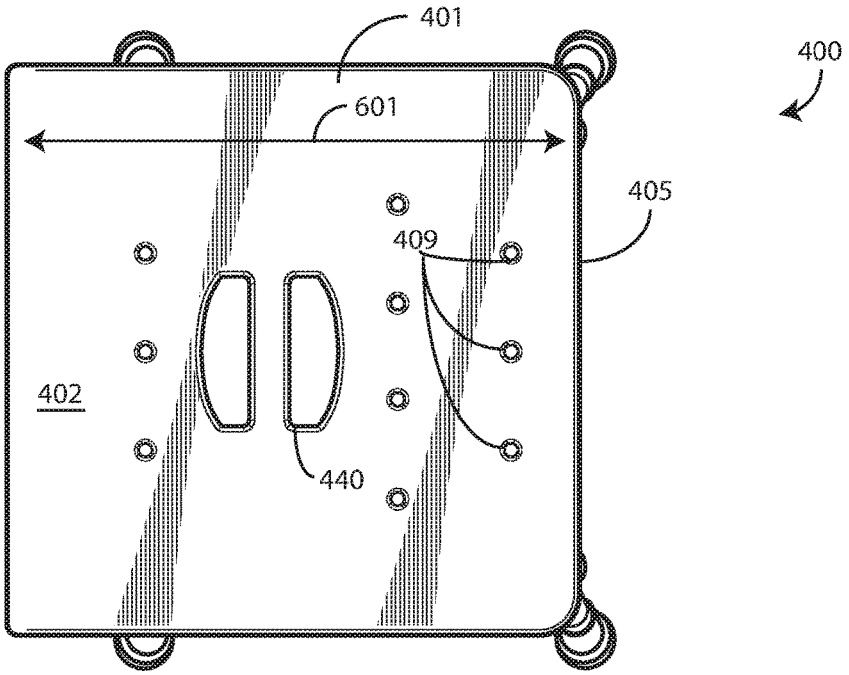
FIG. 6 illustrates a top plan view of a bench in accordance with one or more embodiments of the disclosure.
Figure 7:
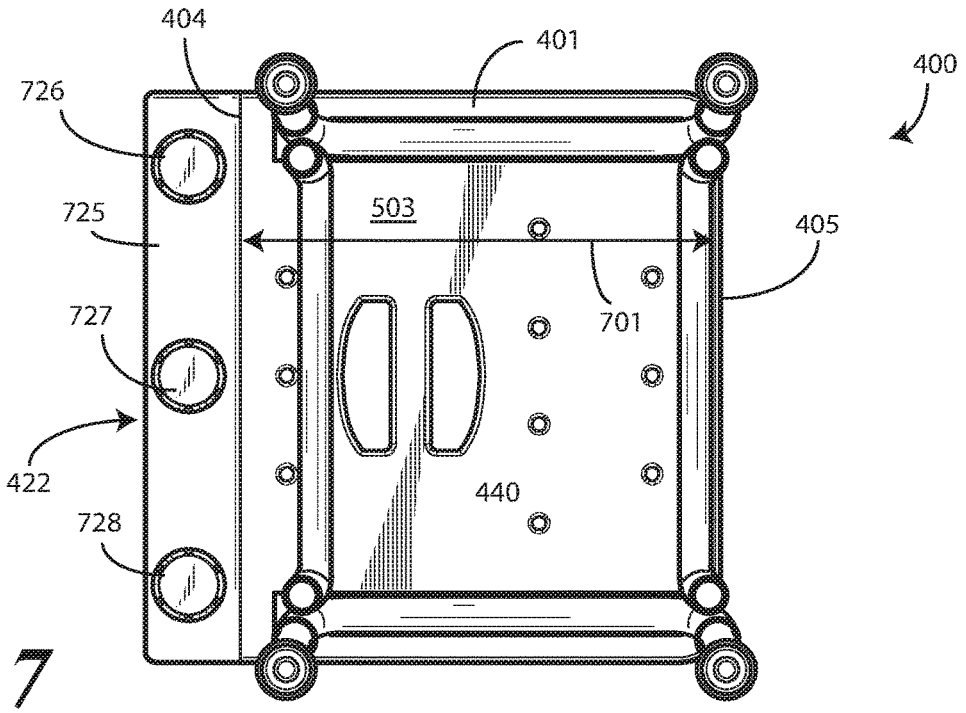
FIG. 7 illustrates a bottom plan view of a bench in accordance with one or more embodiments of the disclosure.

In this illustrative embodiment, the other substantially planar portion 401 is rectangular when viewed in the plan view of FIG. 6. However, the other substantially planar portion 401 could take other shapes as well. Additionally, while the transfer surface 406 in this illustrative embodiment is substantially planar, in other embodiments it can have contours, recesses, and/or protrusions to better fit portions of a user's anatomy.

In one or more embodiments, the first major face 402 includes a textured surface 408 disposed along the first major face 402 of the transfer surface 406. This textured surface 408 is optional. Where included, it creates an exciting ornamental aesthetic. At the same time the textured surface 408 also provides grip and control to the user when in use. In other embodiments, however, the textured surface 408 is omitted and the first major face 402 of the transfer surface 406 is substantially smooth.

In one or more embodiments, one or more apertures 409 are disposed along the transfer surface 406 to provide integrated drainage features. The textured surface 408, where included, may also include raised portions disposed along selective areas to allow for water drainage through the one or more apertures 409. Additionally, where included the textured surface 408 can increase friction, helping to ensure a user does not slip off the transfer surface 406. Embodiments of the disclosure contemplate that too many voids disposed along the transfer surface 406 may weaken the structural integrity of the bench 400. The textured surface 408 may also function to direct water to some of the apertures 409 as well.

As shown in FIGS. 4-7, one or more legs 410,411,412,413 are coupled to the second major face 503 of the other substantially planar portion 401. The one or more legs 410,411,412,413 are disposed beneath the transfer surface 406 when the bench 400 is in use. Accordingly, the one or more legs 410,411,412,413 are configured to support the transfer surface 406, and perform a supporting function when the bench 400 is in use.

The number of legs may vary. In the illustrative embodiment of FIGS. 4-7, the one or more legs 410,411,412,413 comprise four legs, each being sized and arranged to provide adequate support for a user when sliding across the transfer surface 406 of the bench 400. In other embodiments, however, the device may include one, two, three, or five or more legs.

In one or more embodiments, the one or more legs 410,411,412,413 are configured to situate on a floor outside a bathtub or shower. The one or more legs 410,411,412,413 may be adjustable. Illustrating by example, the one or more legs 410,411,412,413 shown in FIGS. 4-7 are adjustable by way of telescoping adjustment mechanisms 414,415,416,417. As will be shown below, in one or more embodiments the bench 400 of FIGS. 4-7 attaches to the device (100) of FIGS. 1-3. The inclusion of the telescoping adjustment mechanisms 414,415,416,417 allows the bench 400 height to be adjusted to match the device (100) of FIGS. 1-3. It also provides adjustability of the transfer surface 406 so that a user can sit at different heights. While telescoping adjustment mechanisms 414,415,416,417 are one example of an adjustment device, other mechanisms allowing adjustment will be obvious to those of ordinary skill in the art having the benefit of this disclosure. The telescoping adjustment mechanisms may have spring-pin or pushbutton engagement members to engage apertures in the one or more legs 410,411,412,413 that allow each of the one or more legs 410,411,412,413 to be locked at a desired height.

The one or more legs 410,411,412,413 may be constructed from a variety of materials. Illustrating by example, in one embodiment the one or more legs 410,411,412,413 are manufactured from steel. In another embodiment, the one or more legs 410,411,412,413 are manufactured from aluminum. In another embodiment, the one or more legs 410,411,412,413 are manufactured from carbon fiber. In another embodiment, the one or more legs 410,411,412,413 are manufactured from plastic. Other materials suitable for manufacturing the one or more legs 410,411,412,413 will be obvious to those of ordinary skill in the art having the benefit of this disclosure.

In one or more embodiments, at least one of the one or more legs 410,411,412,413 is configured to keep the bench 400 stable on a tile or other type of floor. At least one of the one or more legs 410,411,412,413 may be configured to prevent the bench 400 from slipping or sliding along the floor. At the same time, it is contemplated that the bench 400 should be easily movable when desired by a user. Accordingly, in this illustrative embodiment each of the legs 410,411,412,413 is capped with a skid-resistant cap. Leg termination devices other than the skid-resistant cap will be obvious to those of ordinary skill in the art having the benefit of this disclosure.

In one or more embodiments, the first bench edge 404 defines a seat receiver 422. The seat receiver 422 of this embodiment extends from an edge of the first major face 402 to an edge of the second major face 503. The seat receiver 422 is selectively attachable to a bench receiver (122) of the device (100) of FIGS. 1-3 in one or more embodiments, as will be described below with reference to FIGS. 8-10. When attached to the bench receiver (122) of a device (100), the seat receiver 422 allows the other substantially planar portion 401 to extend the substantially planar portion (101) of the device (100) along the plane (107) defined by the substantially planar portion (101) by a predefined additional width, which in this illustrative embodiment is the width 601 of the first major face 402 of the other substantially planar portion 401.

In the illustrative embodiment of FIGS. 4-7, the seat receiver 422 defines a concave-down recess 523 that is cut into the other substantially planar portion 401. In this illustrative embodiment, the seat receiver 422 comprises a first side 424 and a second side 725, which intersect at a substantially orthogonal angle. This results in the seat receiver 422 defining a concave-down inverted L-shaped recess, with the inverted L-shape 501 shown in FIG. 5.

Figure 5:
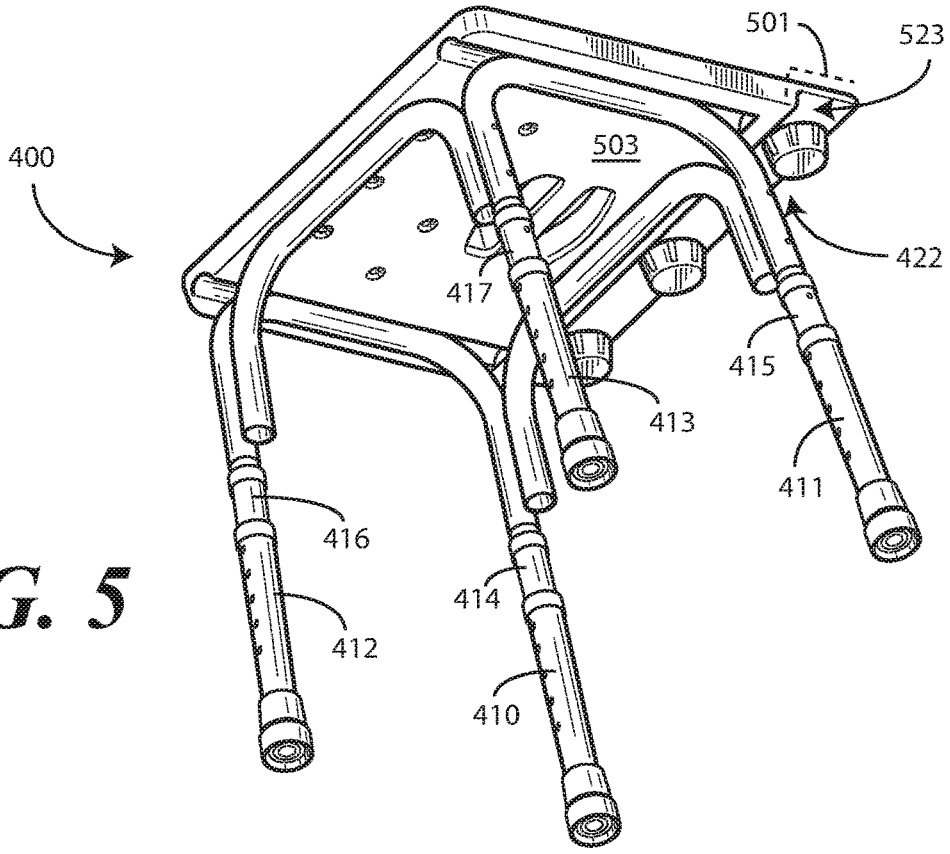
FIG. 5 illustrates a second perspective view of a bench in accordance with one or more embodiments of the disclosure.

In the illustrative embodiment of FIGS. 4-7, the first side 424 of the seat receiver 422 is substantially orthogonal with the second major face 503 of the other substantially planar portion 401, as best seen in FIG. 5. The second side 725 of the seat receiver 422 is then substantially orthogonal with the first side 424, thereby defining the interior of the inverted L-shape 501.

In one or more embodiments, the concave-down inverted L-shaped recess comprises at least one connector 726,727, 728. In the illustrative embodiment of FIGS. 4-7, the concave-down inverted L-shaped recess comprises three connectors 726,727,728, with each being disposed along the second side 725 of the seat receiver 422. In other embodiments, one, two, or four or more connectors could be used.

While the connectors 726,727,728 can be any of various types of connectors, such as male connectors, female connectors, snap connectors, and so forth, in the illustrative embodiment of FIGS. 4-7 the three connectors 726,727,728 comprise at least one male connector. Specifically, in this illustrative embodiment the three connectors 726,727,728 are three male connectors, each defining a protuberance in the second side 725 of the seat receiver 422. In this illustrative embodiment, the protuberances are frustoconical, as shown in FIG. 5. As used herein, a "frustoconical" shape is the shape of a frustum of a cone, namely, the shape of a cone with the tip removed, e.g., having the shape of a cone with the narrow end, or tip, removed. In other embodiments, the protuberances can be cylindrical. While the protuberances are circular in shape in FIGS. 4-7, they can take other shapes as well, including squares, triangles, polygons, or free-form shapes.

As the seat receiver 422 is a concave-down inverted L-shape, with male connectors 726,727,728, and as the bench receiver (122) of FIGS. 1-3 is a concave-up L-shape, with female connectors (126,127,128), it becomes apparent that the seat receiver 422 and the bench receiver (122) are complementary in geometry. This is intentional, as the seat receiver 422 is intended to couple to the bench receiver (122) in one or more embodiments. Said differently, in one or more embodiments the seat receiver 422 is selectively attachable to the bench receiver (122), and vice versa. Accordingly, attachment of the seat receiver 422 to the bench receiver (122) works to couple bench 400 to the seat (106) to extend the substantially planar portion (101) of FIGS. 1-3 along the plane (107) by the predefined additional width, which is the width 601 of the other substantially planar portion 401 in this illustrative embodiment.

In one or more embodiments, the male connectors 726, 727,728 are selectively insertable into the female connectors (126,127,128) to couple the bench 400 to the seat (106) of FIGS. 1-3. The insertion of the male connectors 726,727,728 into the female connectors (126,127,128) works to laterally retain the bench 400 to the seat (106). However, the bench 400 can be removed from the seat (106) by lifting the bench 400 vertically. To make this possible, in one or more embodiments the other substantially planar portion 401 defines a handgrip 440.

In one or more embodiments, when force is applied to lift the first major surface, i.e., a surface of the other substantially planar portion 401 disposed opposite the one or more additional legs 410,411,412,4113 in a direction normal to the surface, this separates the bench 400 from the seat (106). Accordingly, to separate the bench 400 from the seat (106), one simply grasps the handgrip 440 and lifts the bench 400 away.

In this illustrative embodiment, the width 601 of the transfer surface 406, which is also the width of the first major face 402, is greater than the width 701 of the second major face 503. Said differently, the width 701 of the second major face 503 is less than the width 601 of the transfer surface 406 in this illustrative embodiment.

Figure 8:
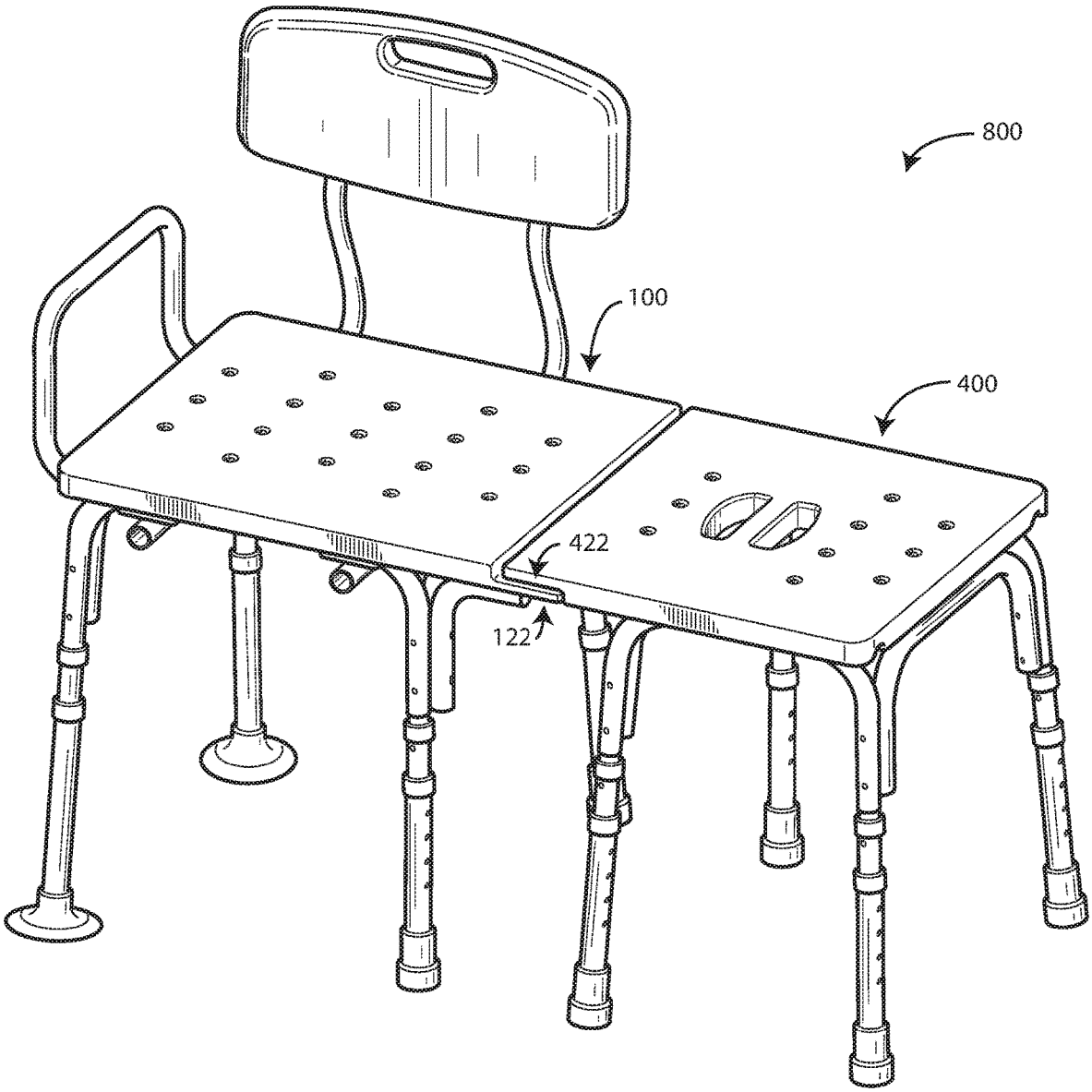
FIG. 8 illustrates a perspective view of one explanatory modular seating apparatus in accordance with one or more embodiments of the disclosure.
Figure 9:
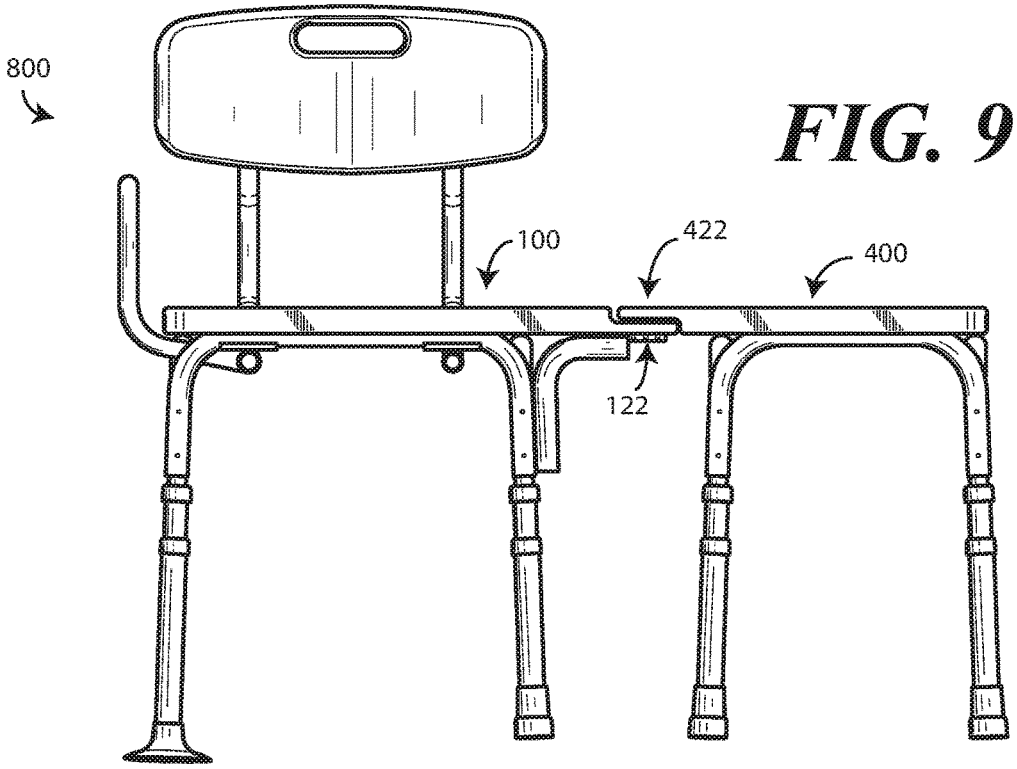
FIG. 9 illustrates a front elevation view of one explanatory modular seating apparatus in accordance with one or more embodiments of the disclosure.
Figure 10:
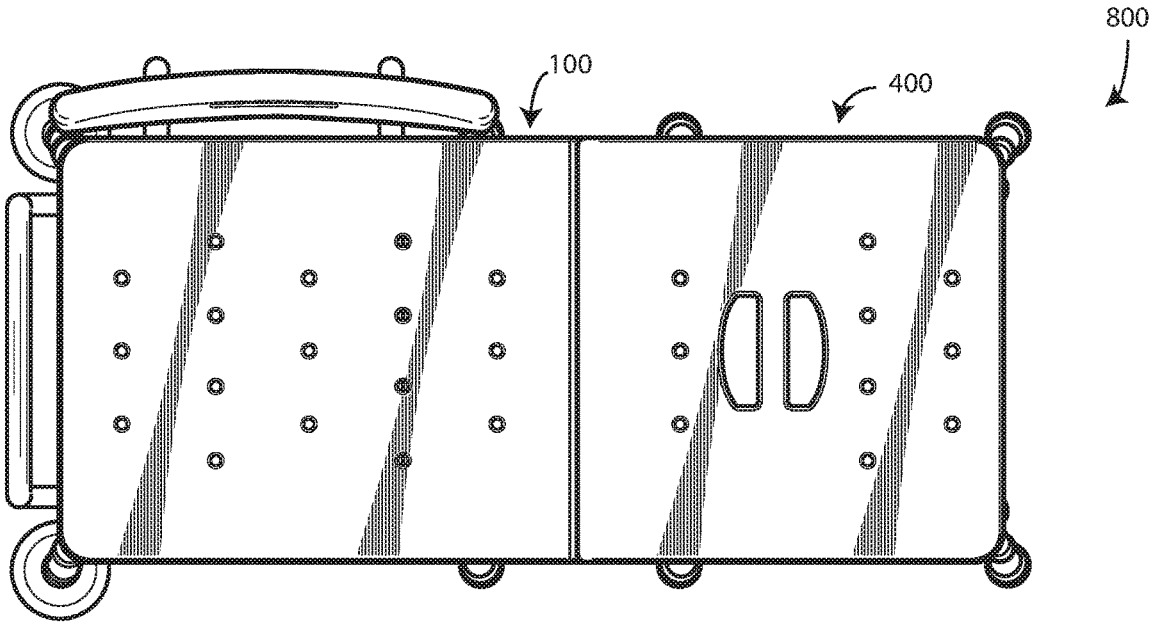
FIG. 10 illustrates a top plan view of one explanatory modular seating apparatus in accordance with one or more embodiments of the disclosure.
Figure 11:
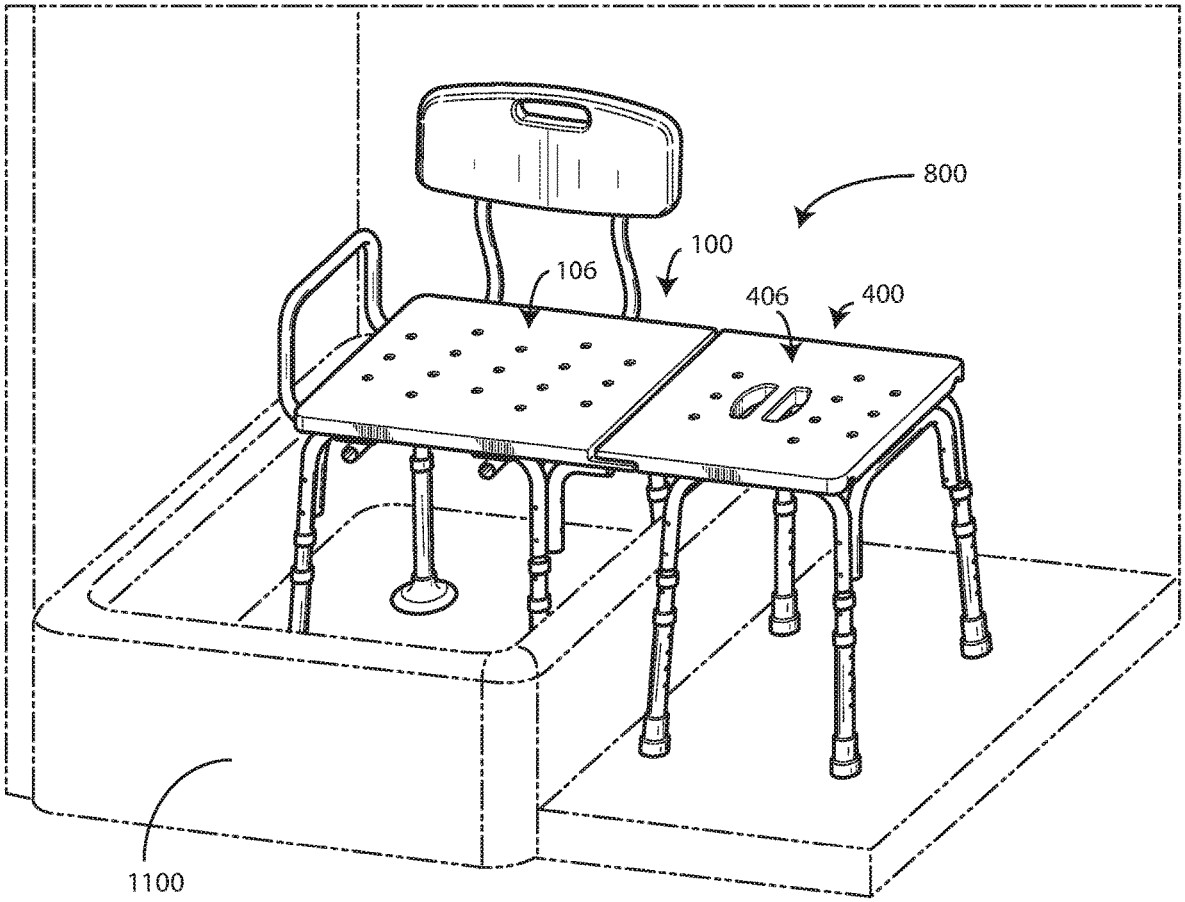
FIG. 11 illustrates one explanatory modular seating apparatus in use in accordance with one or more embodiments of the disclosure.

Turning now to FIGS. 8-10, the seat receiver 422 of the bench 400 has been coupled to the bench receiver 122 of the device 100. Accordingly, a transfer bench 800 has been created. In one embodiment, each of the seat receiver 422 and the bench receiver 122 has a collective width, when joined, to allow the coupled sections to straddle the edge of a tub. Turning now to FIG. 11, illustrated therein is how this occurs.

As shown in FIG. 11, the device 100 is positioned within a tub 1100, while the bench 400 is positioned outside the tub 1100. While a tub 1100 is shown for illustration, the transfer bench 800 can be used with a shower as well. When in the configuration shown in FIG. 11, a person can move, for example, from a wheel chair to the transfer surface 406 of the bench 400. The person can then slide across the transfer surface 406 onto the seat 106.

Figure 12:
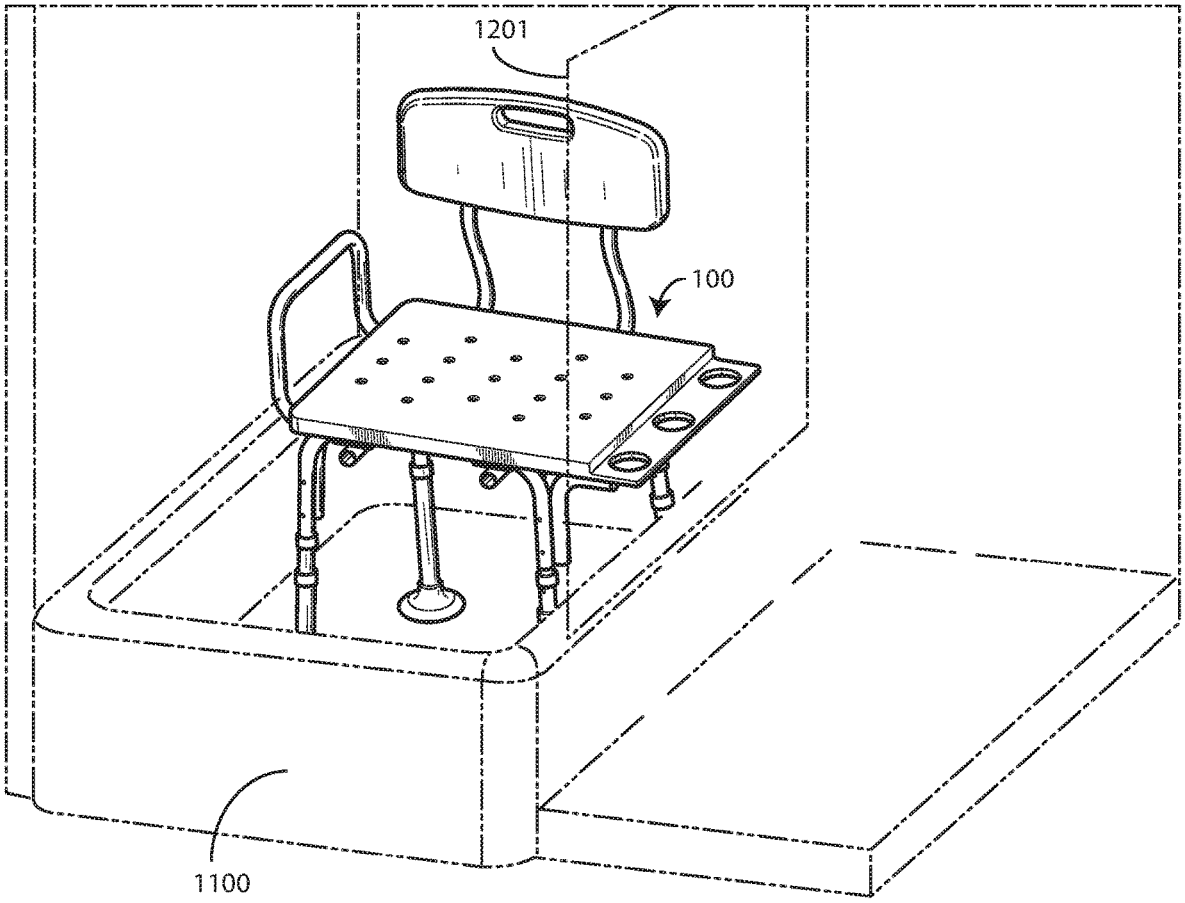
FIG. 12 illustrates one explanatory modular seating apparatus in use in accordance with one or more embodiments of the disclosure.

Once this occurs, the person can lift the handgrip 440 to remove the bench 400 from the device 100. This is shown in FIG. 12. Turning now to FIG. 12, once the bench (400) is removed, a shower curtain 1201 or shower door can be closed so that the person can bathe. When finished, the bench (400) can be reattached to the device 100, as shown in FIG. 11, to allow the person to exit the tub 1100.

In the foregoing specification, specific embodiments of the present disclosure have been described. However, one of ordinary skill in the art appreciates that various modifications and changes can be made without departing from the scope of the present disclosure as set forth in the claims below. Thus, while preferred embodiments of the disclosure have been illustrated and described, it is clear that the disclosure is not so limited. Numerous modifications, changes, variations, substitutions, and equivalents will occur to those skilled in the art without departing from the spirit and scope of the present disclosure as defined by the following claims. Accordingly, the specification and figures are to be regarded in an illustrative rather than a restrictive sense, and all such modifications are intended to be included within the scope of present disclosure. The benefits, advantages, solutions to problems, and any element(s) that may cause any benefit, advantage, or solution to occur or become more pronounced are not to be construed as a critical, required, or essential features or elements of any or all the claims.

What is claimed is:

1. A device, comprising:

a substantially planar portion defining a seat; and one or more legs coupled to, and supporting, the seat;

the seat comprising a first seat edge defining a bench receiver that is selectively attachable to a seat receiver of a bench to extend the substantially planar portion along a plane defined by the substantially planar portion by a predefined additional width.

2. The device of claim 1, wherein the bench receiver defines a concave-up recess into the substantially planar portion.

3. The device of claim 2, the concave-up recess defining a concave-up L-shaped recess.

4. The device of claim 3, wherein the concave-up L-shaped recess comprises at least one female connector.

5. The device of claim 4, wherein the at least one female connector comprises three female connectors.

6. The device of claim 5, further comprising the bench.

7. The device of claim 6, the bench comprising:

another substantially planar portion;

one or more additional legs to support the another substantially planar portion;

the another substantially planar portion comprising a first bench edge defining the seat receiver of the bench, wherein:

the bench receiver is geometrically complementary to the seat receiver; and the seat receiver is selectively attachable to the bench receiver, thereby coupling the bench to the seat to extend the substantially planar portion along the plane by the predefined additional width.

8. The device of claim 7, the seat receiver defining a concave-down recess into the another substantially planar portion.

9. The device, of claim 8, the concave-down recess defining a concave-down inverted L-shaped recess.

10. The device of claim 9, the concave-down inverted L-shaped recess comprising at least one male connector.

11. The device of claim 10, wherein the at least one male connector comprises three male connectors.

12. The device of claim 11, the three male connectors selectively insertable into the three female connectors, respectively, to couple and retain the bench to the seat.

13. The device of claim 11, the another substantially planar portion defining a hand grip, wherein force applied to a surface of the another substantially planar portion disposed opposite the one or more additional legs in a direction normal to the surface separates the bench from the seat.

14. The device of claim 7, wherein each of the substantially planar surface and the another substantially planar surface each comprising one or more apertures disposed therealong, the one or more apertures allowing water to pass through the substantially planar surface and the another substantially planar surface, respectively.

15. The device of claim 1, the substantially planar portion defining a second seat edge, disposed opposite the substantially planar portion from the first seat edge, further comprising an armrest coupled to the second seat edge.

16. The device of claim 15, the substantially planar portion defining a third seat edge extending from the first seat edge to the second seat edge, further comprising a backrest coupled to the third seat edge.

17. A device, comprising:

a substantially planar portion comprising a first major surface defining a seat; and one or more legs coupled to a second major surface of the substantially planar portion, the one or more legs supporting, the seat;

wherein the second major surface is wider than the first major surface; and the substantially planar portion defines a bench receiver extending from an edge of the first major surface to an edge of the second major surface, wherein the bench receiver is selectively attachable to a seat receiver of a bench to extend the first major surface along a plane defined by the first major surface by a predefined additional width.

18. The device of claim 17, the bench receiver defining a first side and a second side, wherein the first side is substantially orthogonal with the first major surface and the second side is substantially orthogonal with the first side.

19. The device of claim 18, further comprising:

a second substantially planar portion comprising a top major surface defining the bench and a bottom major surface supported by one or more other legs;

wherein the top major surface is wider than the bottom major surface; and the second substantially planar portion defines a seat receiver extending from an edge of the top major surface to an edge of the bottom major surface, wherein the seat receiver is selectively attachable to the bench receiver.

20. The device of claim 18, the top surface defining a first edge, the bottom surface defining a second edge, wherein the seat receiver comprises a first surface extending substantially orthogonally from the first edge and a second surface extending substantially orthogonally from the first surface.

* * * * *